United States Patent [19]

Richey

[11] Patent Number: 4,632,390

[45] Date of Patent: Dec. 30, 1986

[54] WEIGHT LIFTING MACHINE

[76] Inventor: Michael L. Richey, 322 E. Sycamore, Galveston, Ind. 49632

[21] Appl. No.: 667,839

[22] Filed: Nov. 2, 1984

[51] Int. Cl.[4] ..... A63B 21/00

[52] U.S. Cl. ..... 272/120; 272/134; 272/144; 272/DIG. 4

[58] Field of Search ..... 272/120, 119, 121, 134, 272/138, 144, DIG. 4, 117; 128/25 R

[56] References Cited

U.S. PATENT DOCUMENTS

| | | | |
|---|---|---|---|
| 232,217 | 9/1880 | Tuttle | 272/120 |
| 2,472,391 | 6/1949 | Albizu | 272/81 |
| 2,733,922 | 2/1956 | Diego | 272/58 |
| 2,783,045 | 2/1957 | Bosch | 272/81 |
| 2,920,890 | 1/1960 | Nawara | 272/58 |
| 3,219,341 | 11/1965 | Weinstein | 272/120 |
| 3,984,101 | 10/1976 | Garza | 272/126 |
| 4,248,420 | 2/1981 | Hayes . | |
| 4,252,314 | 2/1981 | Ceppo | 272/117 |
| 4,272,074 | 6/1981 | Sferle | 272/120 |
| 4,383,684 | 5/1983 | Schliep | 272/120 |
| 4,468,025 | 8/1984 | Sferle | 272/120 |

FOREIGN PATENT DOCUMENTS 376602 4/1907 France ..... 272/144

OTHER PUBLICATIONS

Advertisement for "Exercenter Home Gym", The Shelburne Company Catalog, Winter/Holiday 1983, at p. 25.

*Primary Examiner*—Robert A. Hafer
*Assistant Examiner*—Arnold W. Kramer
*Attorney, Agent, or Firm*—Killworth, Gottman, Hagan & Schaeff

[57] ABSTRACT

An exercising device of the weight-lifting type is disclosed wherein the weight acted on by the user includes at least a portion of the user's body weight. The exercising device has a base and a bench for supporting the user above the base. The bench includes a first support for supporting a first end of the bench, and a second support for supporting a second end of the bench. A platform is supported by the base for supporting the first support. An adjustment is provided for adjusting the longitudinal position of the first support on the platform. Additionally, a first exercise bar is provided along with a flexible line for connecting the first exercise bar to the platform to permit the user to raise and lower the bench by moving the first exercise bar.

18 Claims, 8 Drawing Figures

WEIGHT LIFTING MACHINE

The present invention relates to exercising devices, and more particularly to exercising devices of the weight-lifting type wherein the weight acted upon by the user includes at least a portion of the user's body weight.

In accordance with the present invention, an exercising device of the weight lifting type is provided wherein the weight acted on by the user includes at least a portion of the user's body weight. The exercising device comprises a base and a bench for supporting the user above the base. The bench includes a first support means for supporting a first end of the bench, and a second support means for supporting a second end of the bench. A platform is supported by the base for supporting the first support means. An adjustment means is provided for adjusting the longitudinal position of the first support means on the platform. Additionally, a first exercise bar is provided along with connecting means for connecting the first exercise bar to the platform to permit the user to raise and lower the bench by moving the first exercise bar.

In a preferred embodiment, the first support means comprises a carriage slidably mounted on the bench for longitudinal movement thereon, and carriage support means movable along the platform for supporting the carriage on the platform. The adjustment means is actuable by the use for adjusting the longitudinal position of the carriage and carriage support means relative to the platform and bench to permit the user to vary the effective weight acted on by the user.

Additionally, the exercise device can include a reel means for varying the effective length of the connecting means to permit the user to vary the distance between the first exercise bar and the bench. The reel means includes a reel around which the connecting means, preferably a flexible line, can be wound and a ratchet for engaging the reel to maintain a selected effective length of the flexible line. A release is provided which is actuable by the user for selectively engaging the ratchet to the reel to permit the user to vary the length of the line from a first selected length to a second selected length.

One aspect of the present invention is that the exercise device is designed to enable the user to lift his own weight, rather than lifting externally applied weights, such as the weights normally attached to barbells. This has the advantage of permitting the user to strengthen his muscles by lifting weight while avoiding the need for using cumbersome and expensive weight and barbell arrangements.

Another aspect of the present invention is that an adjustment means is provided which enables the user to vary the effective weight that he is lifting. This adjustment means has the advantage of permitting the user to adjust the effective weight he is lifting to fit his particular needs. For example, it is envisioned that a beginning user will lift only a relatively small percentage of his weight, whereas an experienced or stronger user will adjust the device to lift a relatively larger percentage of his weight.

One feature of the present invention is that a variably positionable platform is provided for supporting the bench. This platform has the advantage of enabling the user to vary the effective force required to move the exercise bar during different stages of the lifting cycle of the exercise bar. For example, the user can adjust the platform so that a relatively small amount of force is required to lift the exercise bar during the initial stage of the lifting cycle, and a progressively greater force is required to lift the exercise bar during the later stages of the lifting cycle. Alternatively, the user can adjust the track so that a relatively greater force is required during the initial stages, and a relatively lesser force is required during the later stages.

Another feature of the present invention is that a selectively actuable reel means can be provided for varying the effective length of the connecting means to permit the user to vary the distance between the exercise bar and the bench. This feature has two primary advantages.

The first advantage provided by the reel means is that the user can adjust the position of the bar to suit his particular needs. By enabling the user to vary the effective length of the connecting means, the user can adjust the rest position of the exercise bar to place the exericise bar at a distance from the bench which is comfortable to the user. Also, the user can vary the length of the connecting means to position the bar properly for different exericises. For example, it is envisioned that the user would place the bar at a relatively small distance above the bench if he were performing bench press exercises (see FIG. 3), and at a relatively large distance above the bench if he were performing leg lifts.

The second major advantage provided by the reel is that it enhances the user's safety by reducing the likelihood that any substantial weight will fall on the user. This enhanced safety is accomplished in two ways. First, the reel means preferably includes an actuating lever within reach of the user when he has his hand on the exercise bar. The actuator allows the user to engage and disengage the ratchet from the reel. When the exercise bar is disengaged from the bench, the bench can lower itself independently of the exercise bar. Through this arrangement, the user can allow the bench to go to a rest position without having to exert a substantial force on the exercise bar.

The second manner in which the enhanced safety is accomplished is through the cooperative relative positioning of the platform and exercise bar. The platform is positioned to have a rest position wherein it rests on a base member of the device, or on the ground. As discussed above, the user can adjust the height of the exercise bar to a selected and comfortable distance above his body as it is positioned on the bench. Normally, the user will make these adjustments to the bar when the platform is in its rest position. During the lowering of the exercise bar, the track is positioned to come to a rest on the ground (or base of the device) before the exercise bar contacts the user's body.

This feature can prevent injury to the user. For example, if the user is performing bench pressing exercises, and loses his grip on the exercise bar, the platform will hit the base and hence stop the movement of the bench before the exercise bar hits the user. After the platform comes to rest on the base, the only force acting on the exercise bar will be its own weight, and not the weight of the bench and user. Preferably, the exercise bar is relatively light to minimize this force.

It is also a feature of the present invention that the weight machine is designed to be readily folded and unfolded. This feature enables the user to store the machine easily between uses. This feature can be especially advantageous for users who purchase the machine for home use, and do not have sufficient room in their houses or apartments to have a separate exercise room.

Two further features of the present invention are that an overhead (pull down) exercise bar can be attached to the device, and that the position of the first exercise bar is variable. These features enable the user to perform a variety of exercises on the device. The variety of exercises performable on the device enables the user to exercise several muscle groups, rather than just one or two muscle groups.

Additional features and advantages of the invention will become apparent to those skilled in the art upon consideration of the following detailed description of a preferred embodiment exemplifying the best mode of carrying out the invention as presently perceived. The detailed description particularly refers to the accompanying figures in which.

Figure 1:
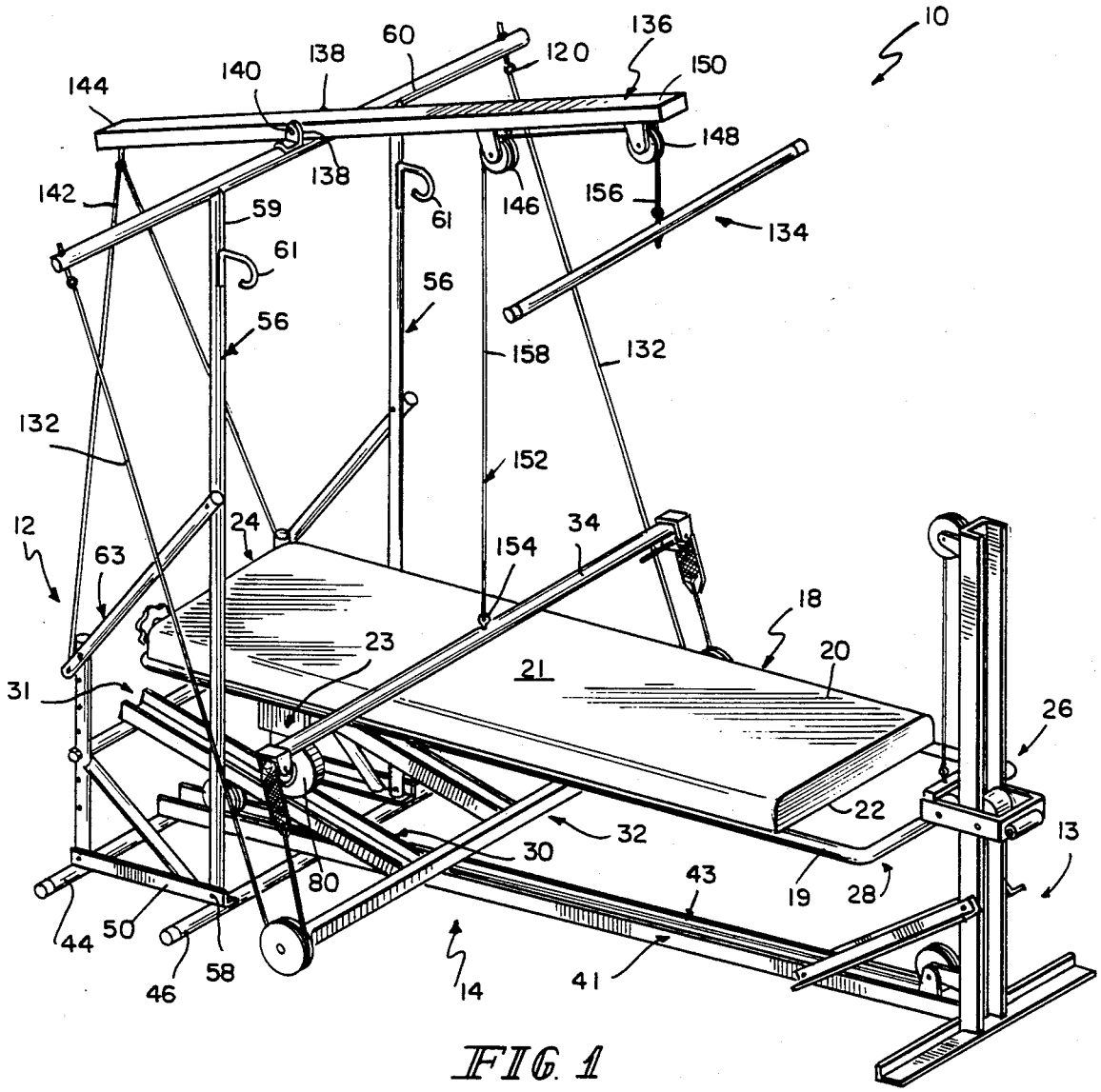
FIG. 1 is a perspective view of the present invention showing a pull down exercise bar.

An exercising device 10 of the weight-lifting type wherein the weight acted upon by the user includes at least a portion of the user's body weight is shown in the figures as including a first (head) end 12 and a second (foot) end 13. A base 14 is provided for supporting the device 10 on the ground, floor, or other surface. A bench 18 includes four linear tubular members which are welded together to form a rectangular frame 19. The bench 18 also includes a cushion 20 having an upper surface 21 upon which the user can rest, and a lower surface 22 which rests on the frame 19 for supporting the cushion 20 on the frame 19. A first support means 23 is provided for supporting a first (head) end 24 of the bench 18, and a second support means 26 is provided for supporting a second (foot) end 28 of the bench 18.

A platform 30 is supported by the base 14 for supporting the first support means 23. The platform 30 includes a first end 31 which is pivotally coupled to the base and a second end 32 which is shown in FIG. 1 resting on the base. A first user-manipulable exercise bar 34 is provided above the bench 18, and connecting means such as flexible line 36 is provided for connecting the first exercise bar 34 to the platform 30.

Figure 2:
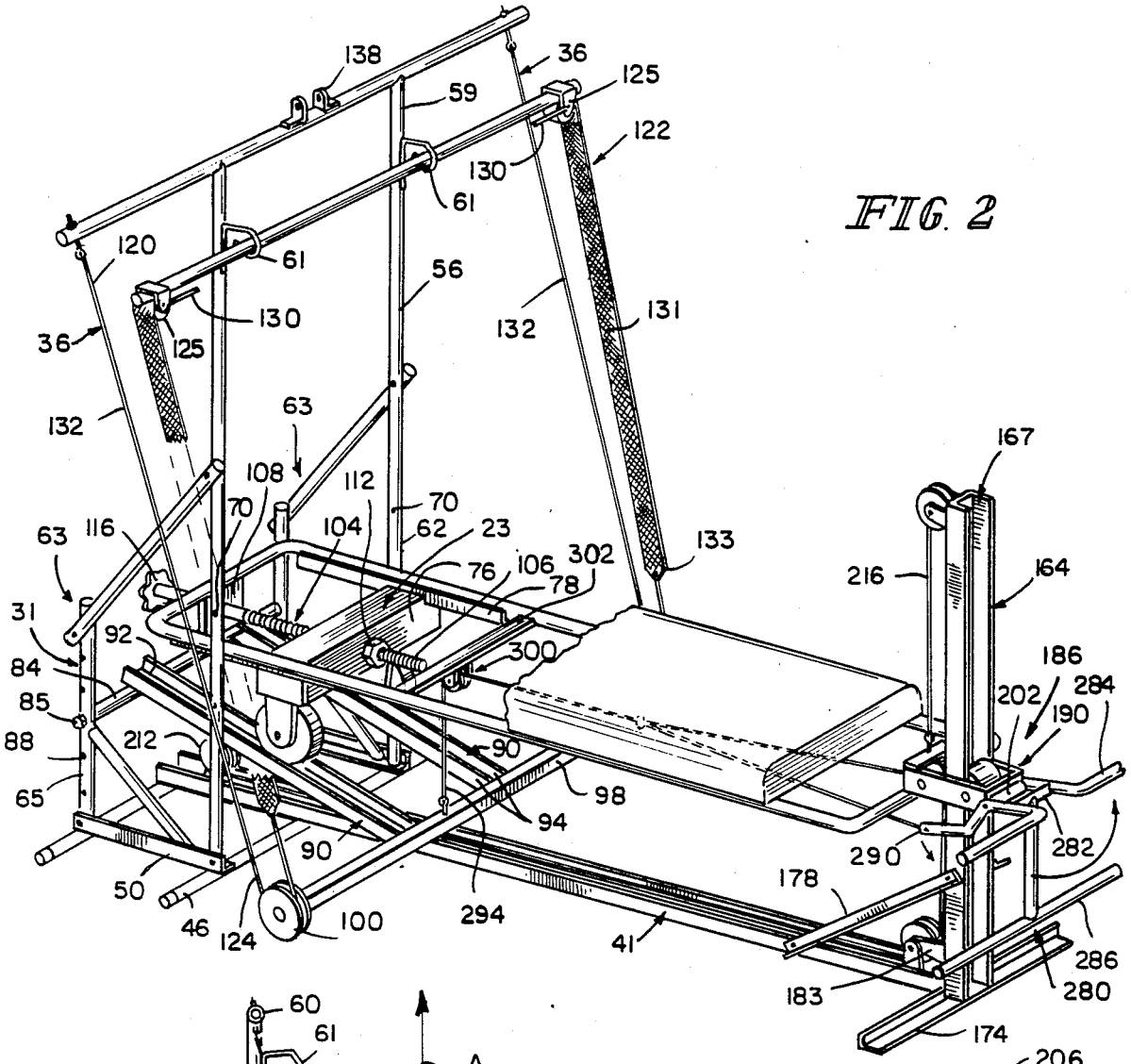
FIG. 2 is a perspective view of the invention with the pull-down exercise bar removed.

As best shown in FIGS. 1 and 2, base 14 includes a longitudinal member 41 which extends generally along the entire length of the device 10. Longitudinal member 41 includes an upwardly opening channel 43. First and second transverse base members 44, 46 are welded to the longitudinal member and extend generally transversely thereto for providing lateral stability to the exercise device 10. A pair of longitudinal members 50 extend longitudinally between the first and second transverse base members 44, 46.

A pair of tubular, upright members 56 is pivotally coupled by pivot 58 to the longitudinal members 50 near their point of connection with second transverse base member 46. Upright members 56 have an upper portion 59 which includes a horizontally disposed support bar 60. Support bar 60 is preferably welded or otherwise fixedly attached to the upper ends of the upright members 56. A pair of hangers 61 are hung onto the upright members for supporting the first exercise bar 34 when the bar 34 is not being used.

Each lower portion 62 of the upright members 56 shown in the figures is formed of one piece. Alternatively, each lower portion 62 can be formed of two pieces to be telescoping.

Figure 6:
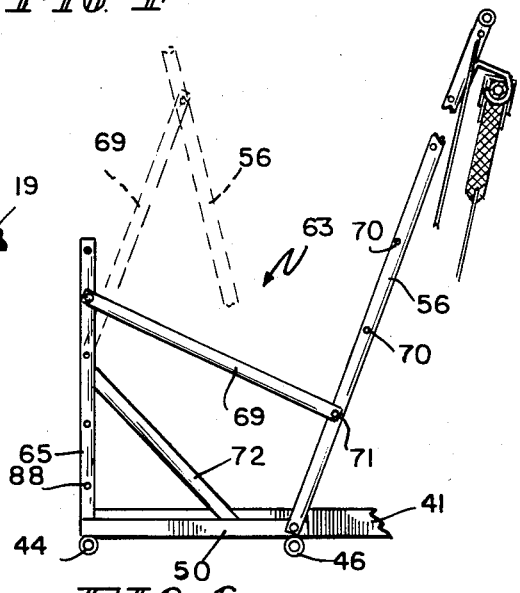
FIG. 6 is a partial, side view of the present invention showing the variably positionable upright member.

As shown in FIGS. 1 and 6, a pair of position-fixing means 63 can be provided for enabling the user to fix the position of the upright member 56 about its pivot 58 at more than one position. The position-fixing means 63 includes an upright, tubular platform support member 65 which is either pivotally engaged, or fixedly attached to longitudinal member 50 at its point of attachment with first transverse base member 44. Preferably, a pair of spaced parallel platform support members 65 are employed. One of the pair is attached to one of the two longitudinal members 50, and the other of the pair is attached to the other of the longitudinal members 50. A pair of tubular cross members 69 are pivotally coupled to the tops of the platform support members 65, and extend between the platform support members 65 and the upright member 56. Several alternative points of attachment 70 are provided on the lower portion 62 of upright members 56. The cross members 69 can be attached to any of the alternative points of attachment 70. Preferably, the points of attachment 70 comprise apertures which are sized to receive a bolt 71 which passes through both the cross members 69 and the upright member 56 to attach the cross member 69 to the upright member 56. As best shown in FIG. 6, when the cross member 69 is attached to one of the lower points of attachment 70, the upright member 56 becomes canted relative to the bench 18, rather than assuming its generally perpendicular relation to the bench 18, as shown in FIG. 1. An angle brace 72 extends between longitudinal member 50 and platform support member 65, to maintain the platform support members 65 generally perpendicular to the longitudinal member 50.

The first support means 23 is shown in FIGS. 2–5 as including a carriage 76 which is slidably mounted on guides 78 for longitudinal movement along the frame 19 of bench 18. Guides 78 preferably comprise angle brackets welded to the frame 19. A pair of spaced wheels 80 are connected to the underside of carriage 76 for supporting the carriage above the platform 30.

Figure 5:
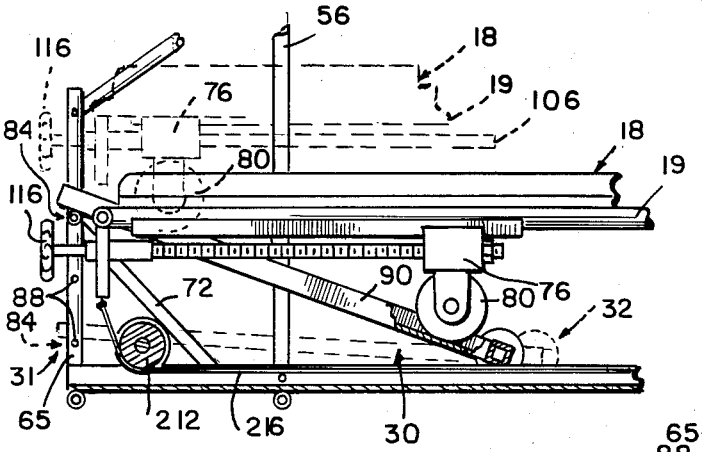
FIG. 5 is a partial, side view of the first end of the bench showing the platform and adjustment means of the present invention.

The first end 31 of platform 30 includes a cylindrically tubular first transverse platform member 84 which is disposed between the two platform support members 65, and pivotally coupled thereto by pivot 85. The platform support member 65 includes a plurality of alternative points of engagement 88, which permit the user to vary the height at which the first end 31 is placed above the base 14. As shown in FIG. 5, when the first transverse platform member 84 is engaged to one of the upper points of engagement 88 (shown in solid), the platform 30 has a rather steep downward slope from its first end 31 to its second end 32. Conversely, when the first transverse platform member 84 is placed in the lowermost alternative point of engagement 88 (shown in phantom), the platform has very little slope from its first end 31 to its second end 32. The platform 30, when in this position, is almost parallel to the base member 14.

This variability in slope of the platform 30 is provided to permit the user to adjust the degree of force required during different stages of the exercising cycle. For example, when the platform 30 is at a relatively steep angle, a relatively greater amount of force will be required initially to raise the first exercise bar 34 and a relatively lesser amount of force will be required as the platform 30 nears horizontal. Conversely, when the platform 30 is generally parallel to the base 14, such as shown in phantom in FIG. 5, the force required to lift the exercise bar will increase as the exercise bar 34 is lifted progressively upward.

Platform 30 also includes a pair of spaced, parallel longitudinal platform members 90, which are best shown in FIGS. 1 and 2. Longitudinal members 90 are welded or otherwise fixed to the proximal end of first transverse platform member 84. Each longitudinal platform member 90 is shown to comprise a channel member including a pair of parallel upstanding sides 94 for maintaining the wheel 80 on the upper surface 92 of the platform member 90.

A second transverse platform member 9 is connected to the distal ends of the longitudinal track member 90. Second transverse track member 98 forms the second end of platform 30, and is generally long enough so that pulleys 100, which are journaled onto the outer ends of member 98, are aligned with the outer end of the exercise bar 34. Additionally, pulleys 100 and the ends of exercise bar 34 should be spaced laterally outwardly from the side of the bench 18 to prevent the bench 18 from interfering with the operation of connecting means 36.

An adjustment means 104 for adjusting the longitudinal position of the first support means 23 on the platform 30 is shown in FIGS. 2–5. The adjustment means 104 includes a threaded shaft 106 which is engaged with a plate 108. Plate 108 is fixedly attached to the first end 24 of bench frame 19. The shaft 106 is journaled in the plate 108 in a manner which permits shaft 106 to be rotated, while being maintained in a fixed longitudinal position. A threaded receiver, such as nut 112, is fixed onto the carriage for receiving the threads of the threaded shaft 106.

A knob 116 or crank (not shown) is provided for enabling the user to rotate the shaft 106 to thereby move the carriage longitudinally through the engagement of the shaft 106 and nut 112. The knob 116 shown in the drawings is a removable knob 116 which includes a stud (not shown) for engaging an aperture (not shown) in shaft 106. Alternatively, the knob can be permanently fixed to shaft 106 and positioned so that the knob does not extend outwardly past the first transverse platform member 84. A fixed knob is disposed inwardly (toward second end) of the first transverse platform member 84 to prevent the knob from interfering or engaging the first transverse platform member 84 during the raising and lowering of the bench 18.

The carriage 76 and wheels 80 are movable longitudinally along the platform 30 to enable a user to vary the effective weight acted upon by the user as he is lifting the exercise bar 34. For a user of a given weight, the user must exert a relatively lesser amount of force to lift himself when the carriage 76 and wheels 80 are positioned adjacent the first end 31 of the platform 30, (shown in phantom in FIG. 5), and must exert a relatively greater force when the carriage 76 and wheels 80 are placed adjacent the second end 32 of the platform 30 (shown in solid in FIG. 5).

The connecting means is shown as a pair of flexible lines 36, with each line 36 having a first end 120 which is attached to the upper portion of the upright members 56. Preferably, the first end 120 is anchored to the support bar 60 portion of the upper portion 59 of the upright members 56. Each line 36 also includes a second end 122 which is anchored to the first exercise bar 34 near the outer end of the first exercise bar 34. The intermediate portion 124 of the line passes around pulley 100 to connect the support bar 60 and exercise bar 34 to the platform 30.

A pair of reel means 125 provided, one for each of the flexible lines 36. Each reel means 125 includes a ratchet (not shown) and an actuating means such as release lever 130. The reel means 125 are provided for enabling the user to vary the effective length of the exercise bar. One reel means 125 which has been used by applicant, and has been found to be effective, is a non inertia type retractable seat belt mechanism. For example, in a model made by applicant, two seat belt retractor mechanisms from a 1972 Ford Pinto were used (one for each of the two lines, 36). The seat belt retractors were modified to each include a release lever 130, which is actuable by the user to engage and disengage the ratchet (not shown) and reel 125. The release levers 130 are preferably biased to normally engage the ratchet (not shown) to the reel 125, and to release the ratchet (not shown) from the reel 125 when the release lever 130 is actuated.

As will be appreciated by those familiar with non-inertia, retractable seat belt mechanisms, the reel 125 and ratchet (not shown) cooperate to permit the seat belt 131 to be pulled out of the retractor freely from a position wherein the seat belt 131 is fully retracted on the reel 125 to a stop point selected by the user. At this stop point, the ratchet engages the reel to prohibit further outward movement of the seat belt 131. The reel 130 includes springs or other mechanism which automatically retract the seat belt 131 into the retractor when the distal end 133 of the seat belt 131 is allowed to move toward the retractor. In the embodiment shown in the figures, the seat belt 131 which was used with the retractor 130 was employed as a part of the flexible line 36. The distal end 133 of the seat belt 131 is connected to a stranded wire cable 132 which comprises the remainder of the flexible line 36.

As shown in FIG. 1, a second pull-down type exercise bar 134 can optionally be attached to the device 10. Second exercise bar 134 is suspended over the bench by a longitudinal bar 136 which is mounted to the center of support bar 60 between a pair of angle brackets 138. A bolt 140 passes through apertures shown in FIG. 2 in the angle brackets 138 and longitudinal bar 136 to engage the longitudinal bar 136 to the angle brackets 138, and hence support bar 60. A pair of anchor lines 142 connect the first end 144 of the longitudinal bar 136 to the platform support members 65, to maintain the longitudinal bar 136 in a generally horizontal orientation. A first pulley 146 is journaled to the underside of the longitudinal bar 136, generally directly above the first exercise bar 34. A second pulley 148 is aligned with the first pulley 146, and is journaled to the underside of the longitudinal bar 136 adjacent the second end 150 of the longitudinal bar 136.

A flexible line 152, such as a metal stranded cable, connects the first exercise bar 34 to the second exercise bar 134, to enable the user to lift the bench 18 upwardly by pulling downwardly on the second exercise bar 134. The flexible line 152 includes a first end 154 which is anchored to the center of the first exercise bar 34, a second end 156 which is anchored to the center of the second exercise bar 134, and a intermediate portion 158 which passes around the first and second pulleys 146, 148, respectively. The second exercise bar 134 is useful in performing various pull-down exercises.

The second support means 26 is shown in FIGS. 1–4 as including an upright second end support member 164 disposed adjacent the second end 28 of the bench 18. Support member 164 is generally U-shaped, and includes a pair of opposed vertical surfaces 168, 170. The U-shaped configuration of the support member form a track 167 adjacent second opposed surface 170. A transversely extending foot member 174 is fixedly attached to the second member 164, but is unconnected to the longitudinal base member 41. A pair of angle braces 178 selectively attach to the upright support member 164 by bolts 180, and selectively attached to base member 41 by bolt 182. A bracket and pivot arrangement 183 pivotally connects the upright support bar 164 to the longitudinal base member 41.

The second end support means 26 also includes means 186 for movably supporting the second end 28 of the bench 18 at a relatively constant angle to the ground during the raising and lowering of the bench 18. The means 186 includes a roller support means such as navigation box 190. Navigation box 190 is comprised of four rectangular plate members which are welded at their ends to form a rectangular structure. Navigation box 190 is selectively attached to the second end of the frame 19 of bench 18 by an eye-bolt 194 and nut 196 A first roller 198 is journaled onto the navigation box 190 and is rollable along a first vertical surface 168. A second roller 200 is journaled to navigation box 190, and is captured by the sides of the track 167 to roll along the second vertical surface 170.

The configuration of the rollers 198, 200, navigation box 190, and track 167 permits the navigation box 190 to navigate only upwardly and downwardly along the upright member 164. The configuration prevents the navigation box 190 from becoming dislodged from the second member 164, and the rollers 198, 200 from becoming dislodged from the first and second surfaces 168, 170. Additionally, the navigation box 190 and rollers 198, 200 fix the longitudinal position of the bench 18 to maintain the wheels 80 of the first support means on the platform 30. Absent this longitudinal fixation means, the rollers 80 would likely roll down the inclined platform 32, thus derailing the bench 18 from the platform 30.

Figure 7:
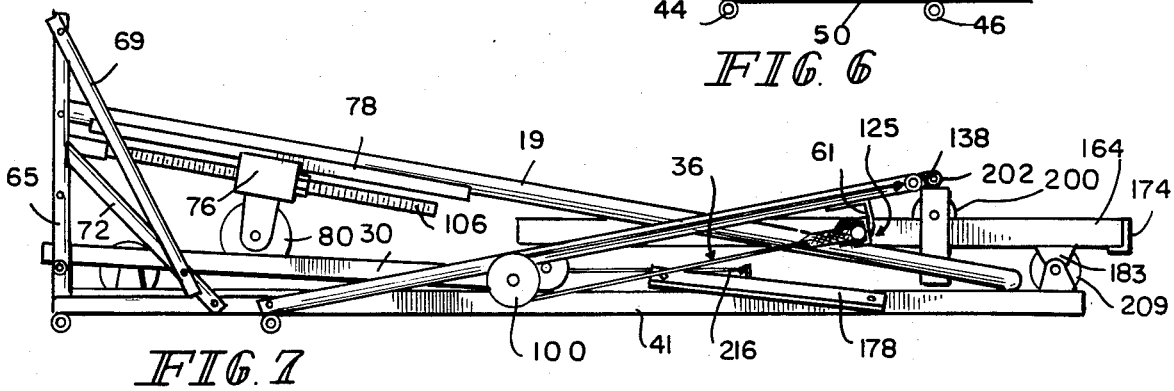
FIG. 7 is a side view of the invention in a folded configuration.

A cylindrical tube 202 is attached to the distal end of the navigation box 190. The tube 202 is provided for being coupled with the angle brackets 138 on the support bars 60 when the device 10 is folded, as shown in FIG. 7. The coupling of the tube 202 and brackets 138 with bolt 140 fixes the positions of the second member 164 and upright member 56 when the device 10 is folded.

The means 186 for movably supporting the second end 28 of the bench also includes a first pulley 206 which is journaled to the top of the second member 164 adjacent the first vertical surface 168. A second pulley 209 is journaled to the longitudinal base member 41 and is aligned with the first pulley 206. Alternatively, the first pulley 206 and second pulley 209 can be journaled adjacent the second vertical surface 170.

A third pulley 212 is journaled onto the longitudinal base member 41 adjacent the first end 12 of the device 10, and is aligned with the second pulley 209. A flexible line 216 includes a first end 218 which is anchored onto the bottom of plate 108 to anchor the line 216 to the first end 24 of bench 18. The second end 220 of the flexible line 216 is anchored to the eye of eye-bolt 194, which, through its connection with frame 19, connects the line 216 to the second end 28 of the bench 18. The intermediate portion 222 of the flexible line passes around the first pulley 206, second pulley 209, and third pulley 212 to raise and lower the second end 28 of the bench 19 at a rate equal to the raising and lowering of the first end 24 of the bench 18 during the raising and lowering of first exercise bar 34. This configuration maintains the bench 18 at a relatively constant angle to the ground during the raising and lowering of the bench 18.

Figure 8:
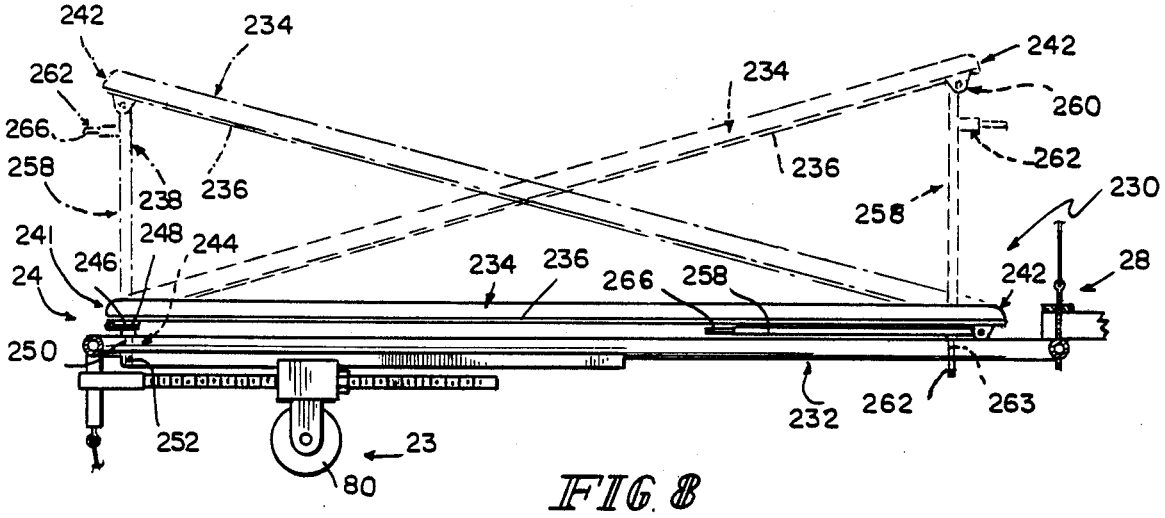
FIG. 8 is a partial side view of an alternate embodiment of the present invention having a variably positionable bench cushion.

An alternate embodiment of the present invention is shown in FIG. 8 as including a variably positionable bench 230. Variably positionable bench 230 includes a frame 232 generally similar to frame 19 and a cushion 234 generally similar to cushion 20, shown in FIG. 1. The cushion 234 can include one or more longitudinal reinforcing members 236.

Bench 230 also includes an angle adjustment means 238 for permitting the user to adjust the angle of the cushion 234 relative to the frame 232 and ground. The first end 241 is selectively pivotally connected to the frame 232 by a hinge pivot 244. Hinge pivot 244 includes a first hinge half 246 which is connected to the underside of cushion 234 adjacent its first end 241, and a second hinge half 248 which is connected to a stud 250. The stud 250 is provided for insertion into an aperture 252 near the first end of the frame 232 for engaging the cushion 234 to the frame 232. A clip (not shown) can be provided for preventing the stud 250 from being lifted out of the aperture 252.

The second end 242 of the cushion 234 is disposed adjacent the second end 28 of the bench 232. An elongate rod 258 is pivotally coupled to the cushion 234 near its second end 242 by a pivot and bracket arrangement 260. The elongate rod 258 includes a transversely extending leg 262. As shown in solid in FIG. 8, when the cushion 234 is placed in a position parallel to the frame 232, the transversely extending leg 262 is positioned to extend through an aperture 263 for securing the second end 242 of the cushion 234 to the frame 232. A clip (not shown) can be provided for maintaining the transversely extending leg 262 in the aperture 263. The elongated rod 258 also includes a colinear reduced diameter stud member 266 at its distal end for insertion into aperture 263 when the second end 242 of cushion 234 is placed at an elevated position, as shown in dashed lines in FIG. 8.

The elongate rod 258 can be of a telescoping type. For example, the elongate rod 258 can comprise a pair of colinear, concentrically disposed telescoping rods having a lock adjustment means for fixedly positioning the two rods with respect to each other, similar to the locking, adjustable telescoping legs found on many camera-supporting tripods. It will also be appreciated that a pair of hinge pivots 244 and a pair of elongate rods 258 are provided at each end of the bench, with one of the hinges 244 and rods 258 engaged to one of the side members of the frame 230, and the other pair of hinge members and rods (not shown) engaging the other side member of frame 232.

The hinge pivot 244, apertures 252, 263, and elongate rod 258 are all selectively engageable with the frame 232 and positioned to permit the user to engage the second end 242 of the cushion 234 adjacent the first end 24 of the bench 230, and the first end 241 of the cushion 234 adjacent the second end 28 of the bench 230. This end for end exchange of the cushion 234 is shown in phantom in FIG. 8.

A foot and leg exercise means 280 which can be attached to device 10 is shown in FIG. 2. The foot and leg exercise means 280 includes a yoke portion 282 which is selectively attached to the cylindrical tube 202 mounted on the navigation box 190. A bolt or other shaft like pivot fastener extends through the yoke portion 282 and cylindrical tube 202 to pivotally mount the foot and leg exercise means 280 to the navigation box 190. As the foot and leg exercise means 280 is mounted to the navigation box 190, it will travel upwardly and downwardly with the upward and downward travel of bench 18.

The foot and leg exercise means 280 also includes an upper leg exercise bar 284 which is useful for leg curls, and a lower leg exercise bar 286 which is useful for leg extension exercises. The upper exercise bar 284 comprises a pair of parallel exercise bars which are spaced by a distance sufficient to permit them to pass on either side of second end support member 164.

A pair of lever arms 290 extends forward from the yoke portion 282, toward the head end 12 of the device 10. The pair of lever arms 290 are also spaced by a distance sufficient to enable them to pass on either side of the second end support member 164. A Y-shaped cable 294 is provided which attaches the foot and leg exercise means 280 to the platform 30. The single leg of Y-shaped cable 294 is attached to the center of the second transverse platform member 98. Each of the double legs of the Y-shaped cable 294 is attached to one of the two lever arms 290. The intermediate portion of the cable 294 passes around a pulley 300 which is journalled to a transverse member 302 of frame 19.

The pivotal movement of foot and leg exercise means 280 moves the platform 30 and bench 18 upwardly and downwardly to permit the user to exercise by exerting a force against his own weight. When exercises are being performed using the foot and leg exercise means 280, the release lever 130 is placed in a release position to disengage the ratchet (not shown) from the reel 125.

The device 10 operates as follows. Before engaging in any exercise activity, the user should first adjust the adjustment means 104 to a desired position. The adjustment means 104 is adjusted by rotation of knob 116, which causes the carriage 76 and wheels 80 to move longitudinally along the bench 19 and platform 30, respectively. As discussed above, the user can increase the amount of effective force required to lift his weight by moving the carriage 76 closer to the second end 32 of platform 30. If so desired the user can also adjust the angle adjustment means 238 (FIG. 8) of the bench 230 to place the cushion 234 at an inclined angle relative to the frame 232.

The user can then climb onto the bench 18 in a manner best suited to perform the exercise that he desires to perform. If the user is desiring to perform bench press exercises, he would mount the bench 18 to position himself on the upper surface 21 of the bench 18 in a manner similar to that shown in FIGS. 3 and 4.

Figure 3:
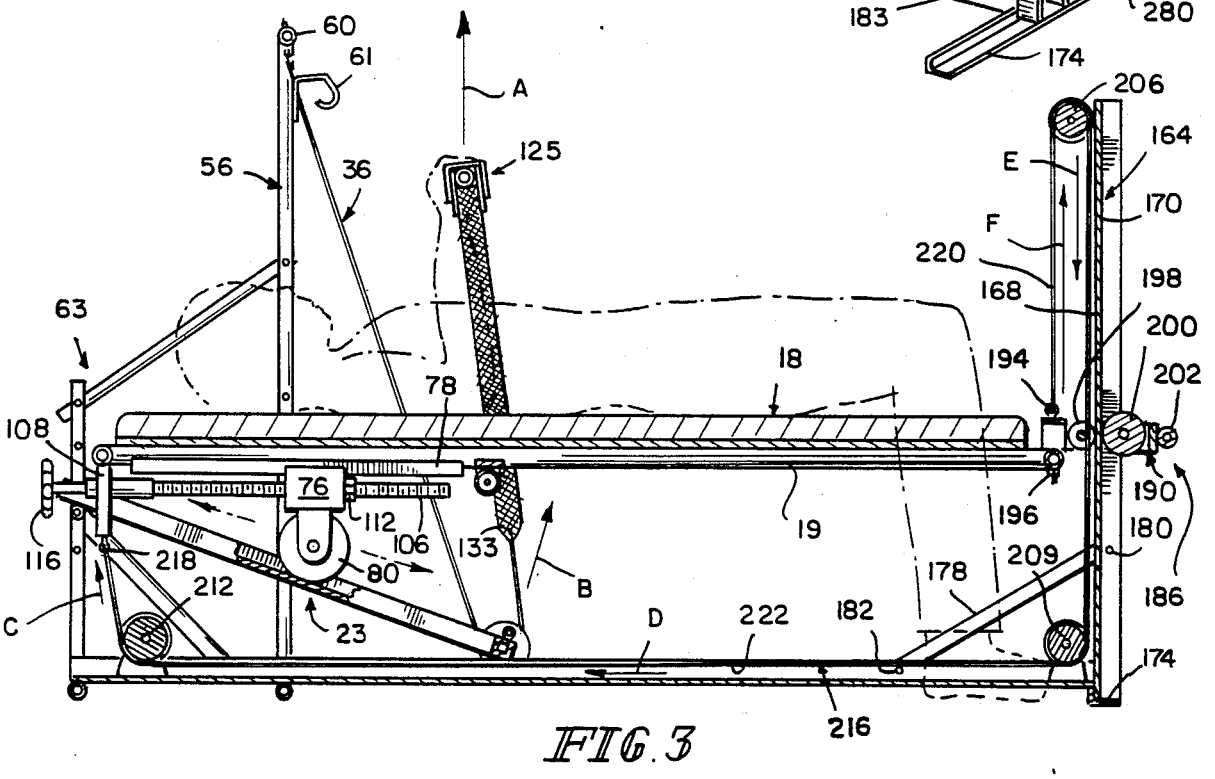
FIG. 3 is a side view of the invention, partly broken away, showing the device in a rest position.

The user then removes the first exercise bar 34 from the hangers 61 (shown in FIG. 1) and grasps the bar 34 with his hands to place the bar 34 at the proper height above his upper torso, as shown in FIG. 3. The reel means 125 automatically retracts the seat belt portion 131 of the line 36 to reduce the effective length of the line 36 to that desired by the user, and the ratchet means (now shown) locks the line 36 at that effective length. When the user pushes upwardly on the exercise bar 34 in a direction indicated generally by arrow A (FIG. 3), the effective length of the line 36 will not increase, as the ratchet (not shown) will prevent the reel means 125 from permitting additional line 36 from becoming unwound from the reel 125. If the user should desire to raise the exercise bar 34 upwardly, without lifting the track 30 and bench 18, he can actuate the release lever 130 and disenage the ratchet from the reel 125, which permits additional line 36 to be unwound from the reel 125, thus increasing the effective length of the line 36. The release of the release lever 130 re-engages the ratchet to the reel 125.

Once the user has the exercise bar 34 at a comfortable position, he can begin his exercise routine, consisting of moving the exercise bar 34 upwardly and downwardly to lift weight. By moving the first exercise bar 34 upwardly and downwardly along arrow A, the user moves the flexible line 36 around pulley 100, and in the process thereof moves the platform 30 about the axis of pivot 85 in a direction indicated generally by arrow B. It will be understood, however, that movement of the exercise bar 34 in any direction generally other than pendular movement will cause the platform 30 to move.

Figure 4:
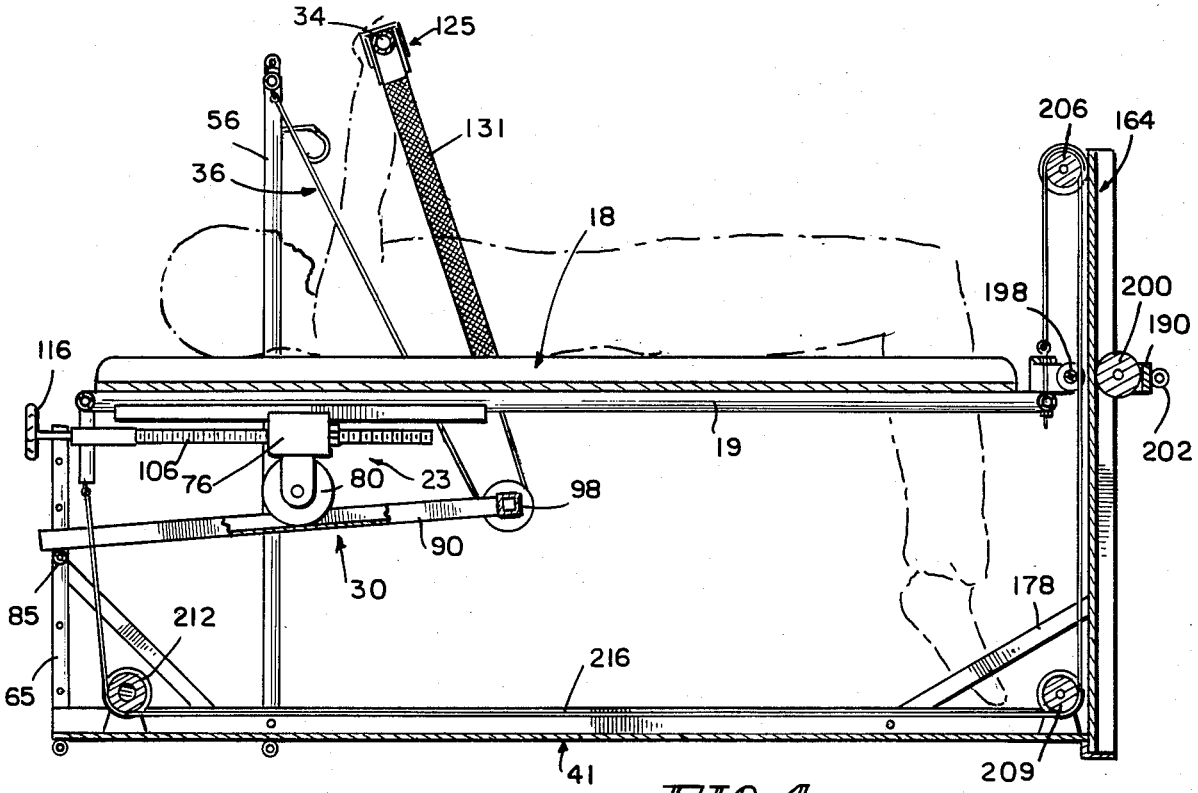
FIG. 4 is a side view of the invention, partly broken away, showing the device in a use position.

As bench 18 is attached to first support means 23, which rests on platform 30, the upward movement of platform 30 causes the first end 24 of the bench 18 to move upward in conjunction with the upward movement of platform 30. The upward movement of bench 18 causes flexible line 216 to move generally upwardly between third pulley 212 and anchor 218, as indicated by arrow C; to move generally laterally between the second 209 and third 212 pulleys, as indicated by arrow D; to move downwardly between the first 206 and second 209 pulleys, as indicated by arrow E; and to move upwardly between its second end 220 and first pulley 206, as indicated by arrow F. The upward movement of line 216 moves second end 28 of bench 18 upwardly. The length of line 216 and positioning of pulleys 206, 209, 212 is preferably designed to move the second end 28 of the bench 18 upwardly at the same rate as the first end 24 of the bench 18. The result of the upward movement of the bench 18 caused by the raising of the exercise bar 34 is shown in FIG. 4. Although the bench 18 is shown in FIGS. 3 and 4 as being generally parallel to the ground during its lifting from its rest position (as shown in FIG. 3) to its raised position (shown in FIG. 4), the bench 18 can also be adjusted to be at a constant, inclined angle throughout its movement from its rest position to its raised position.

As shown in FIG. 3, when the bench 18 is in its rest position, the second transverse platform member 98, and hence second end of the platform 30, rests on the longitudinal base member 41. This feature is incorporated into the design of the present invention to enhance the safety of the device 10. It will be appreciated that if the bar 34 slips from the user's hands or if the user is unable to maintain the bar 34 in a raised position during his exercise cycle, the second end 32 of the platform 30 will come to rest on the longitudinal base member 41, and hence stop the travel of the bench 18, before the exercise bar 34 hits the user's chest. Thus, the only force which will be applied by the bar 34 on the user's chest is that force caused by the weight of the relatively light exercise bar 34, and not the force caused by the weight of the bench 18, platform 80, and user. This feature makes it less likely that the user will sustain any injury, such as cracked ribs and the like, by falling exercise bars 34. Additionally, if the user becomes tired at any point during his exercise routine, he can actuate the release levers 130 which, by disengaging the ratchet from the reel means 125, permits the bench 18 and platform 30 to be lowered independently of the exercise bar 34. This feature helps to obviate the need for providing "spotters" or the like.

Although FIGS. 3 and 4 show a user performing bench press exercises, several other "lifting" type exercises can be performed using first exercise bar 34.

If the user desires to perform pull down exercises, he can attach the longitudinal bar 136 to the support bar 60, the anchor 142 to the longitudinal bar 136, and platform support member 65 and the cable 152 to the first exercise bar 34 and the second exercise bar 134. When so configured, the downward movement of second exercise bar 134, through its connection with first exercise bar 34, raises the bench 18 upwardly. The exercises which can be performed with the aid of the second exercise bar 134 will be apparent to those skilled in the art.

As best shown in FIG. 7, the device 10 can also be folded for storage. The upright member 56 and second end member 164 fold from a use position (shown in FIG. 1) wherein they are generally perpendicular to the base member 41, to a folded position (shown in FIG. 7) wherein the upright member and second end support member 164 are generally parallel to the longitudinal base member 41. Additionally, when the device 10 is placed in its folded position, the first transverse platform member 84 is connected to the lowermost point of engagement 88 of the platform support member 65, to position the bench 18 downwardly as far as possible. The cross member 69 is connected to the angle brace 72 to maintain it in a storage position. The L-shaped brackets 138 on the top surface of the support bar 60 are engaged to cylindrical tube 202 on the nagivation box 190 to secure upright member 56 and second end member 164 to each other. Additionally, the second vertical member 164 is placed over the frame 19 for securing the second end of the bench 18 in its storage position.

In order to move second end upright member 164 from its vertical position to its storage position, bolt 182 is removed from its engagement with longitudinal member 41, to disenage angle brace 178 from longitudinal member 41. Second end upright member 164 is then rotated about the pivotal connection between bracket 183 and pulley 209 to a point wherein the second end upright member 164 is generally parallel with longitudinal member 41. Brace 178 is then reconnected to longitudinal member 41 at a point closer to the first end 12 of the device 10. This reconnection of angle brace 178 maintains the second end member 164 in horizontal position. The horizontal position of second end member 164 over frame 19 maintains the bench 18 in its folded position. When so connected, the device 10 can safely be tilted by 90° and stored in an upright position, with the platform support member 65 serving as a foot to support the device 10 in its upright, folded position.

Alternately, as shown in FIG. 7, angle brace 178 can be disengaged from upright support member 164 by the removal of bolt 180. The angle brace 178 can then be rotated about the pivot formed by bolt 182 to place the angle brace 178 in a substantially horizontal position.

Although the invention has been described in detail with reference to certain preferred embodiments an specific examples, variations and modifications exist within the scope and spirit of the invention as described and as defined in the following claims.

What is claimed is:

1. An exercising device comprising an elongated frame means having a first and a second upstanding means, the first upstanding means pivotally supporting, above the lower end thereof, a first end of a platform means for movement of a second end of the platform means in a generally vertical arc, a bench means having a first end and second end, the bench means including a carriage means disposed therebelow, said carriage means being supported on said platform means for supporting a first end of the bench means, means for supporting said second end of the bench means on said second upstanding means to permit vertical movement of said second end of said bench means, first flexible means having one end coupled to the frame means, the other end coupled to an exercise bar means disposed above said bench means, with the middle portion of said flexible means passing around means mounted to said platform means, and second flexible means having a first portion operatively coupled to the frame means generally above the bench means, a second portion operatively coupled to the second end of the bench means, and a third portion operatively coupled to either said platform means, said carriage means, or said bench means therabout.

2. The invention of claim 1 wherein the means around which the middle portion of the first flexible means passes comprises a pulley rotatably mounted to the platform means.

3. The invention of claim 1 further comprising adjustment means for adjusting the position of the carriage means on the platform means.

4. The invention of claim 1 wherein the first flexible means includes a reel means for varying the effective length of the first flexible means.

5. The invention of claim 4 wherein the reeel means includes a ratchet means for engaging the reel means to maintain the first flexible means at a selected effective length.

6. The invention of claim 5 further comprising a release actuatable by the user for selectively releasing the ratchet means and reel means to permit the user to vary the length of the first flexible means between a first selected effective length and a second selected effective length.

7. The invention of claim 1 wherein the first upstanding means is pivotally coupled to another portion of the frame means, and includes position fixing means for maintaining the first upstanding means in a fixed position.

8. The invention of claim 1 further comprising a second exercise bar and second exercise bar coupling means for operatively coupling the second exercise bar to the first flexible means to permit the user to raise the bench means upwardly by pulling the second exercise bar downwardly.

9. The invention of claim 1 wherein the frame means includes an upright member having an upper portion, further comprising a longitudinal bar connected to the upper portion of the upright member, the longitudinal bar including at least one pulley, a second exercise bar and a flexible exercise bar coupling means having a first end connected to the first exercise bar, a second end connected to the second exercise bar, and a middle portion which passes around the pulley on the longitudinal bar, the second exercise bar and pulley on the longitudinal bar being cooperatively positioned to permit a user to move the bench upwardly by pulling the second exercise bar generally downwardly.

10. The invention of claim 1 wherein the platform means includes a first transverse platform member pivotally coupled to said first upstanding means, at least one longitudinal platform member, the longitudinal platform member including a surface for supporting said carriage means, and a second transverse platform member disposed generally parallel to the first transverse platform member, the second transverse platform member including said means mounted to the platform means around which the first flexible means passes.

11. The invention of claim 10 wherein said carriage means is supported on said longitudinal platform member.

12. The invention of claim 1 wherein said carriage means is slideably mounted to said bench means, and said carriage means includes a wheel means rotatably supported on said platform means, further comprising an adjustment means connected to said carriage means for adjusting the longitudinal position of the carriage mean on the bench means to thereby adjust the longitudinal position of the wheel means on the platform means.

13. The invention of claim 1 wherein the first upstanding means includes platform supporting alternative points of engagement to permit the user to vary the height at which the first end of the platform means is pivotably coupled to the frame means.

14. The invention of claim 1 wherein said second upstanding means includes first and second opposed vertical surfaces, and said means for supporting the second end of the bench means includes a roller support means connected to the second end of the bench means, a first roller rollable along the first vertical surface, and a second roller rollable along the second vertical surface.

15. The invention of claim 1 further comprising an angle adjustment means for adjusting the angle of the bench means relative to the ground.

16. The invention of claim 1 further comprising leg lift exercise bar means operatively coupled to the exercising device adjacent the second end of the bench means.

17. A exercising device comprising an elongated frame means having a first upstanding means adjacent a first end and second upstanding means adjacent a second end, the first upstanding means pivotally supporting, above the lower end thereof, a first end of a platform means for movement of a second end of the platform means in a generally vertical arc, with the second end of the platform means being disposed between the first and second upstanding members, a bench means having a first end and a second end, and carriage means disposed therebelow, said carriage means being supported on said platform means for supporting a first end of the bench means, means for supporting said second end of the bench means on said second upstanding means to permit vertical movement of said second end of said bench means, first flexible means having one end coupled to the frame means above the bench means with the other end coupled to an exercise bar means disposed above said bench means, with the middle portion of said flexible means passing around means mounted to said platform means, and second flexible means having one end coupled to either the second end of the bench means or to said means for supporting the second end of said bench means and passing around means mounted on said second upstanding means above said bench means and continuing downward around means on said frame means below said bench means and with the other and fixed to either said platform means, said carriage means, or said bench means thereabout.

18. The invention of claim 17 wherein said means mounted on said second upstanding means above said bench means around which the second flexible means passes comprises a pulley, said means on said frame means below said bench means around which said second flexible means passes comprises a pulley, and a third pulley disposed generally below the first end of the bench means around which the said second flexible means passes.

* * * * *